United States Patent [19]

Cain et al.

[11] 4,135,986

[45] Jan. 23, 1979

[54] ONE-SPOT ROTARY COKE QUENCHING CAR

[75] Inventors: George R. Cain, Pittsburgh; Ward F. Gidick, West Newton; William D. Edgar, Allison Park, all of Pa.

[73] Assignee: Koppers Company, Inc., Pittsburgh, Pa.

[21] Appl. No.: 871,962

[22] Filed: Jan. 24, 1978

Related U.S. Application Data

[63] Continuation-in-part of Ser. No. 785,366, Apr. 4, 1977.

[51] Int. Cl.[2] ..... C10B 33/00; C10B 39/10

[52] U.S. Cl. ..... 202/227; 202/263

[58] Field of Search ..... 202/227, 228, 229, 230, 202/262, 263; 201/39

[56] References Cited

U.S. PATENT DOCUMENTS

| | | | |
|---|---|---|---|
| 1,421,445 | 7/1922 | Frankel | 202/227 |
| 2,785,115 | 3/1957 | Borch | 202/227 X |
| 3,367,844 | 2/1968 | Cremer | 202/227 |
| 3,780,888 | 12/1973 | Hoffman | 202/227 X |
| 3,840,436 | 10/1974 | Lorrek | 202/263 |
| 4,010,081 | 3/1977 | Martt | 202/263 X |

*Primary Examiner*—Morris O. Wolk
*Assistant Examiner*—Arnold Turk
*Attorney, Agent, or Firm*—R. Lawrence Sahr; Oscar B. Brumback

[57] ABSTRACT

A generally cylindrical drum of heat stress and corrosion resistant construction, and having an opening therein, is rotatably mounted on a frame movable on rails along the coke side of the coke oven battery. A movable cover is fixed to the shell and covers the opening in the shell through which hot coke passes, when pushed from a coke oven chamber. A hood is fixed to the structure supporting a coke guide and has a movable portion that coacts with the rotatable shell when coke gravitates into the shell. The drum is rotatable to several positions. Means are included to quench the hot coke and to extract the particulate laden steam which is generated by the quenching operation. Additional means are included to remove noxious gases and particulate matter which emanates from the hot coke.

7 Claims, 14 Drawing Figures

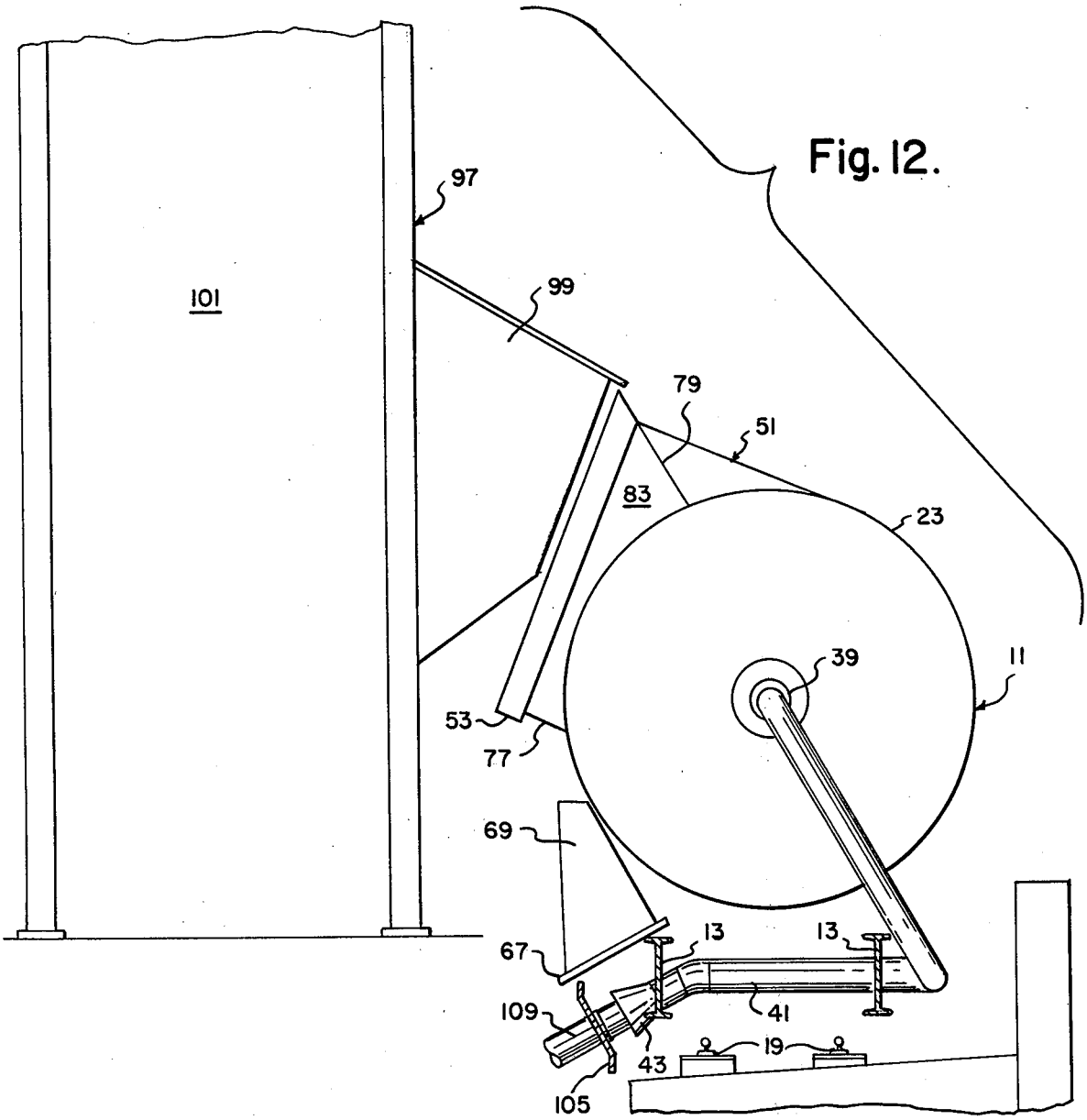
Fig. 12.
Fig. 13.
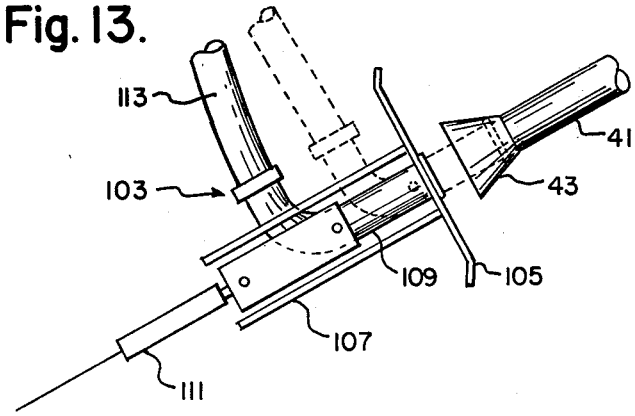

ONE-SPOT ROTARY COKE QUENCHING CAR

CROSS-REFERENCE TO RELATED APPLICATION

This application is a continuation-in-part of application Ser. No. 785,366 filed Apr. 4, 1977.

BACKGROUND OF THE INVENTION

1. Field of the Invention

The invention pertains to horizontal coke oven batteries generally and, more particularly, to apparatus for one-spot catching, transporting and quenching of hot coke after it is pushed from a chamber of a horizontal coke oven battery.

2. Description of the Prior Art

A horizontal coke oven battery is comprised of a series of side-by-side coking chambers that extend transversely from the common longitudinal line of the battery. Coke that is produced in the coke oven battery is discharged from each coking chamber at the coke side of the battery. Conventionally, tracks extend parallel with and adjacent to the coke side of the battery. A coke receiving car runs along these tracks. The coke receiving car is positioned below the level of the coke ovens.

In a conventional coke oven operation, the coke receiving car is located adjacent the coke side of the particular oven to be discharged. Interposed between the open coke oven and the coke receiving car is a coke guide, the purpose of which is to direct the discharging coke into the coke receiving car. Concurrent with the commencement of the discharge of coke, the coke receiving car is drawn slowly past the coke guide, the object being to evenly distribute the coke within the coke receiving car. The full charge of a single coke oven is discharged into the coke receiving car which is then transported to a quenching station where a large volume of water is sprayed from overhead onto the hot incandescent coke to cool it. From the quenching station, the coke receiving car is transported to a coke wharf whereon the quenched coke is dumped.

The conventional coke receiving car has an open gondola-style hopper with a bottom sloped away from the coke oven battery and toward the coke wharf. The side of the hopper adjacent the lowest point of the sloped bottom has dump gates mounted thereto which can be pivoted open to dump the coke.

In operation, one end of the hopper of the coke receiving car is positioned adjacent to, but just below, the discharge end of the coke guide. A signal is sent to the pusher machine operator on the opposite side (pusher side) of the coke oven battery. A common means of signalling utilizes the whistle of the locomotive which is used to move the coke receiving car. At the signal, the push commences and the incandescent coke begins to gravitate through the coke guide down into the open hopper. Concurrently, the locomotive operator causes the locomotive to begin slowly moving the gondola past the coke guide point of coke discharge. Thus the coke becomes more or less evenly spread in the hopper.

The even spreading of the coke within the hopper is important to the quenching operation. Once the coke receiving car has received the full contents of the coke oven, it is moved by the locomotive to a quenching station. The object of the quenching operation is to, as rapidly as possible, cool the coke to a temperature below its oxidation point. However, it cannot be cooled below a point at which the heat of the coke will not rapidly evaporate the residual moisture to dry the coke. If the coke is uneven within the hopper, either those portions of the pile which are deeper will not be sufficiently cooled or those portions of the pile which are shallow will be cooled too much. The result is inconsistent coke quality, the coke being either too oxidized or containing too much moisture.

The quenching operation comprises spraying a given volume of water onto the incandescent coke within a certain period of time. As a rule of thumb, approximately 500 gallons of water are used to quench each ton of coke and the quenching operation is performed in a time period of approximately 30 to 90 seconds.

After the coke has been quenched, the coke receiving car is moved to a coke wharf by the locomotive. A conventional coke wharf is in the form of an inclined plane, positioned to form an extension of the sloped floor of the hopper of the coke receiving car. To discharge the coke onto the coke wharf, simply, doors or gates in the side of the hopper, adjacent the coke wharf, are opened and the coke rolls out onto and down the incline of the coke wharf.

Enter the environmentalists who perceived, among other things, that the before described operations cause large quantities of pollutants, in the form of noxious gases and particulate matter, to be expelled into the atmosphere. A hue and cry was raised which persuaded legislative bodies to propound regulations which mandate that coke battery operators cease and desist from so polluting the atmosphere. The only problem was, and still is, a mere question of how.

Initially, the developments in the area of control of pollution emanating from coke discharge and quenching operations were directed at enclosing the whole operation. Large shed-like structures were built to cover the whole coke side of coke oven batteries. Ventilation and pollution control equipment were built into the enclosures. Experimentation proved that although the pollution problem was abated to some degree, the enclosure system could not eliminate the pollution to the degree required by regulation. And further, the enclosure system proved to be extremely costly both in terms of capital expenditure and in terms of operation.

The second order of approach to eliminating the pollution problem was, generally, to enclose the passageway that the coke traveled through on its way from the oven into the coke receiving car and to enclose, or screen, the hopper of the coke receiving car, the idea being to contain the emanating noxious gases and particulate matter, at least until the coke receiving car was moved to the quenching station. An example of this approach to solving the problem is found in U.S. Pat. No. 3,984,289, issued to Sustarsic et al. on Oct. 5, 1976. The disclosure of this patent, however, still contemplates the movement of a conventionally sized quench car and hopper, slowly, past the coke guide.

A third order of approach to eliminating the pollution problem was to stationarily position, or spot, the coke receiving car, rather than slowly moving it, during the discharge of coke from the coke oven. Pollution control equipment was generally the same as that found in U.S. Pat. No. 3,984,289. An example of a system utilizing this type of "one-spot" coke receiving car is found in U.S. Pat. No. 3,868,309 issued to Sustarsic et al. on Feb. 25, 1975. Thus began the evolution of the one-spot coke quench car concept. The great distinguishing advantage of the one-spot concept was recognized to be that it eliminated the need for a moving seal on the gondola or hopper of the one-spot car. The seals could be stationarily fixed into position prior to the discharge of coke, making a much tighter seal design possible. A slowly moving car requires a continuously moving seal which, in turn, requires a looser fit of the seal; the result is a less effective seal in terms of containing pollution. The distinction is further described in application Ser. No. 846,892 filed Oct. 31, 1977, by Becker, Jr. et al. along with the problems inherent in the one-spot quench car concept.

The prior art in the field of cylindrical or rotary quench cars is outlined in application Ser. No. 785,366 filed Apr. 7, 1977 by Cain et al., as well as the application of a rotating cylindrical concept to one-spot coke quench cars. The present application is a continuation-in-part of that application.

The critical factors which are necessary to distinguish a one-spot quench car as technologically and commercially viable are twofold. The car must be capable of eliminating the discharge of noxious gases and particulate matter into the ambient atmosphere. And the car must lend itself to satisfactory quenching of the incandescent coke therein. These factors are added to the basic requirements of all coke receiving cars, that is, the ability to contain the full volume of coke discharged from a coke oven, the ability to transport the coke to the quench station and then the coke wharf, and the ability to discharge the coke onto that coke wharf.

Those skilled in the art will recognize that when a coke receiving car is stationarily spotted adjacent a coke guide, the oven volume of coke discharged into the hopper of that car will naturally pile up to form a mound. To contain this mound, the hopper must be deeper. But the mound itself is of unequal depth as measured vertically at different points. And the average depth of the mound is much greater than the shallow depth of coke that is spread in a conventional coke car which is slowly drawn before the coke guide during the coke discharge.

Conventionally, the coke is quenched by spraying water onto the shallow layer of coke which is fairly evenly spread in a conventional coke receiving car. Those skilled in the art have heretofore assumed that identical quenching methods could be satisfactory when applied to a relatively deep mound of coke piled in a one-spot quench car. Such has not proven to be the case. The application of conventional quenching methods to mounded coke in one-spot quench cars has produced either a coke that is adequately quenched, coming from the mound surface, with highly oxidized coke from the interior of the mound; or coke that is overcooled, containing a too high moisture content, coming from the interior of the mound. Generally, the quality of the coke produced by such a method is inconsistant in oxidation and water content and not of uniform size.

A partial solution to the problem is to level the coke within the hopper, thus producing a more even depth. But the coke still remains at a much greater depth than the shallow spread coke of conventional coke receiving cars. Means are needed to concurrently quench both the interior of the coke pile and the surface.

SUMMARY OF THE INVENTION

The present invention provides a simple car having an enclosable drum whose axis is parallel with the line of travel of the car and parallel with the horizon. The drum rotates through a limited arc to tumble spread the coke therein. Pressurized means are provided to agitate and concurrently quench all of the coke within the drum, not limited to the surface. The car is operable with currently used gas and dust removal equipment and conventionally designed coke wharfs.

BRIEF DESCRIPTION OF THE DRAWINGS

FIG. 12 is a transverse sectional view of the one-spot quench car with the drum hopper in position for quenching of the coke in conjunction with a steam suppressor.

FIG. 13 is an enlarged view of the pressurized water input connection showing its extended and retracted position.

DESCRIPTION OF THE PREFERRED EMBODIMENT

Figure 1:
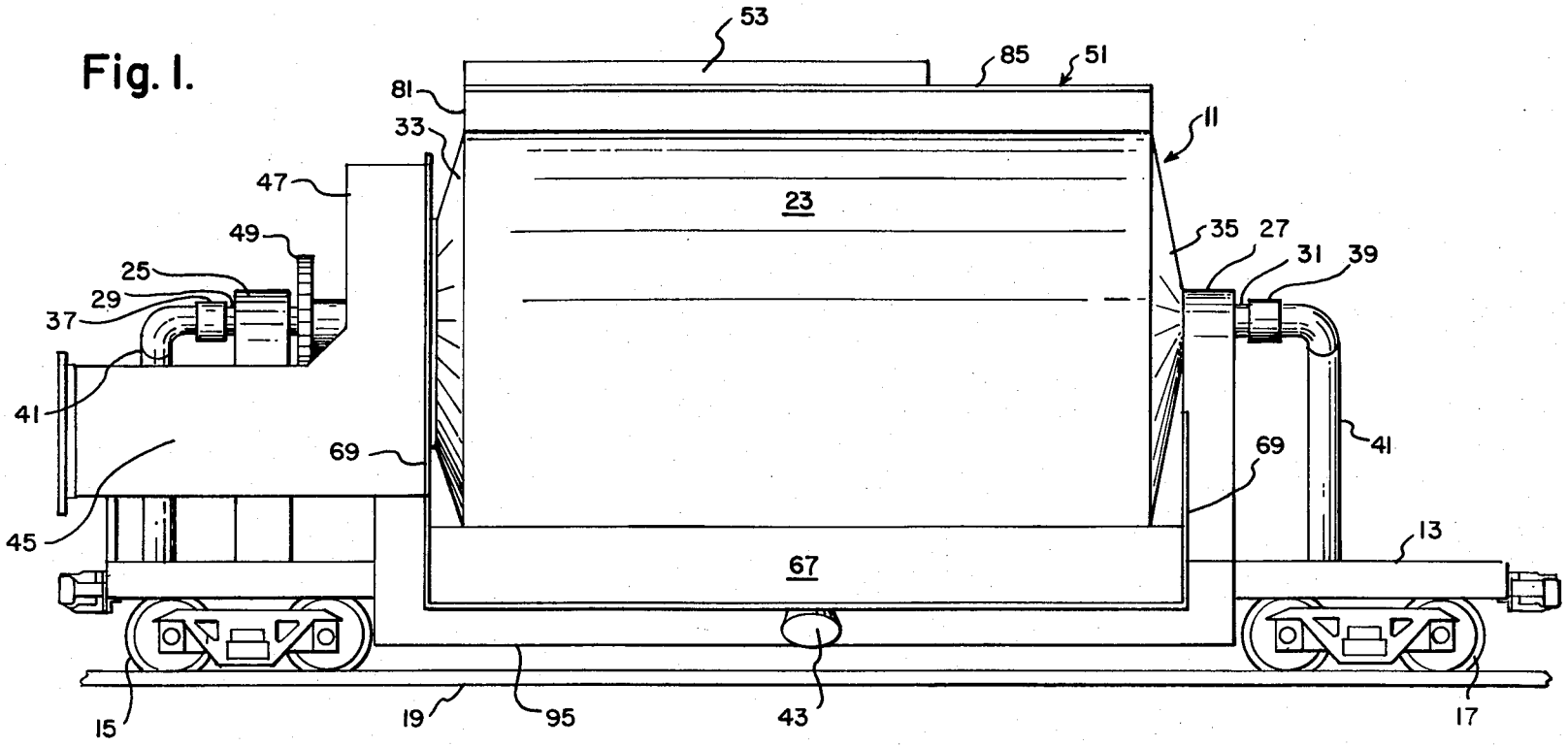
FIG. 1 is a side view of the one-spot quench car as viewed looking toward the coke side of a coke oven battery.
Figure 14:
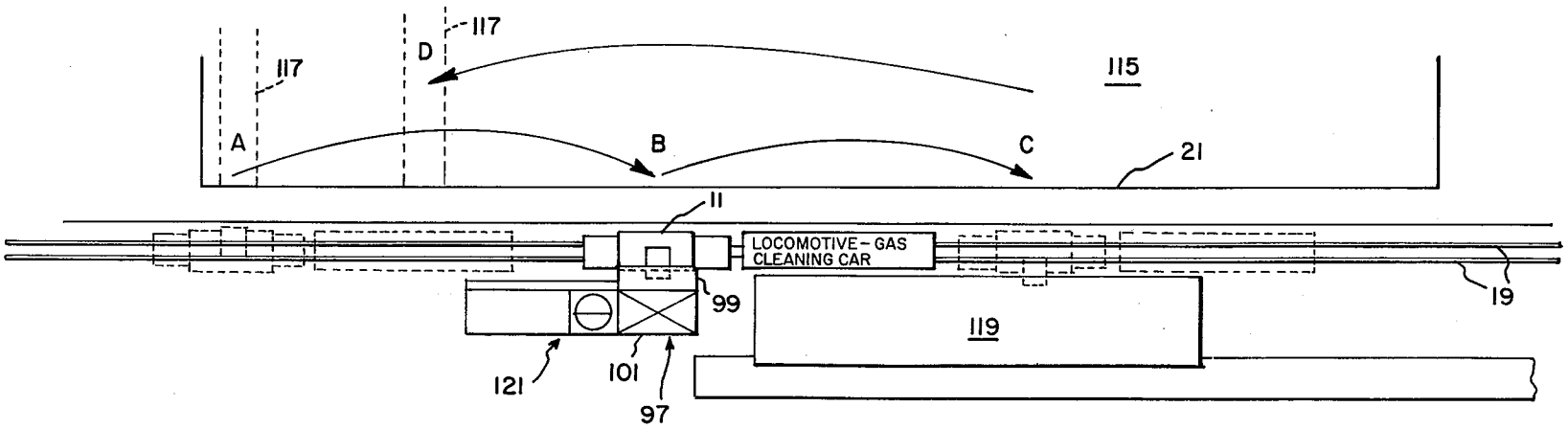
FIG. 14 is a schematic lay-out diagram of the arrangement of the elements of the system in which the present invention is operable.

Referring to FIG. 1, there is illustrated a rotatable cylindrical coke quench car 11 in accordance with the present invention, including an elongated flat bed frame 13 mounted to front 15 and rear 17 wheeled trucks that travel on rails 19. The rails 19 run longitudinally parallel adjacent the coke side 21 of a coke oven battery 115, shown in FIG. 14. The axis of the individual coke oven chambers 117, also shown in FIG. 14, are horizontally perpendicular to the line of the rails 19. A rotatable cylindrical drum hopper 23 is mounted on the frame 13 with its axis parallel to the axis of the frame 13 and the line of the rails 19. The axis of the drum hopper 23 is parallel with the horizon. The means for mounting the drum hopper 23 to the frame 13 include a front 25 and a rear 27 bearing mount positioned about where illustrated in FIG. 1. Means for rotating the drum hopper 23 include a hollow cylindrical front stub shaft 29 and a hollow cylindrical rear stub shaft 31. The stub shafts 29 and 31 are aligned with the horizontal axis of the drum hopper 23. The front stub shaft 29 is fixadly mounted through the front end 33 of the drum hopper 23. The rear stub shaft 31 is fixably mounted through the rear end 35 of the drum hopper 23. Rotatable pipe pressure coupling connectors 37 and 39 are fixed to each of the outboard ends of the stub shafts 29 and 31, about where shown in FIG. 1. A pipe manifold 41 connects each of the rotatable connectors 37 and 39 to a quench water input funnel 43 which is positioned about midpoint of the coke quench car 11 below the line of the frame 13 about where shown in FIG. 1. Thus, the pipe manifold 41 forms a stationary conduit connected to a rotatable conduit, the stub shafts 29 and 31. A fume duct section 45 extends from a fume extraction means 47. The fume extraction means 47 is operationally mounted to the front end 33 of the drum hopper 23. Means for rotation (not shown) operates a bull gear 49 mounted to the front stub shaft 29. The drum hopper 23 has mounted thereto a rectangular projection or riser 51 extending the full length of the drum hopper 23. Slidable mounted onto the riser 51 is a cover seal 53.

Figure 2:
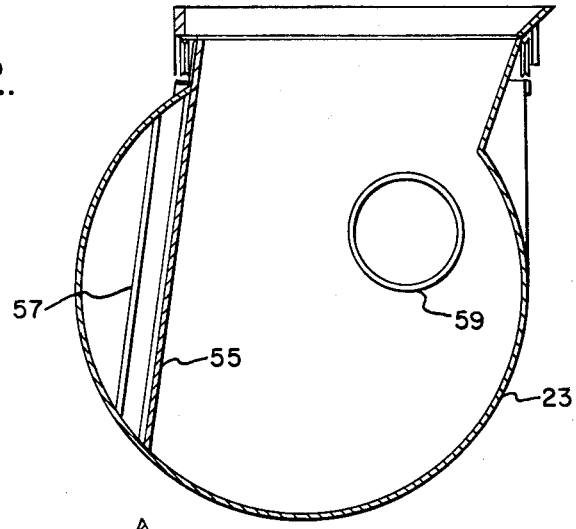
FIG. 2 is a transverse sectional view of the drum hopper of the one-spot quench car positioned to receive coke from a coke oven battery.
Figure 3:
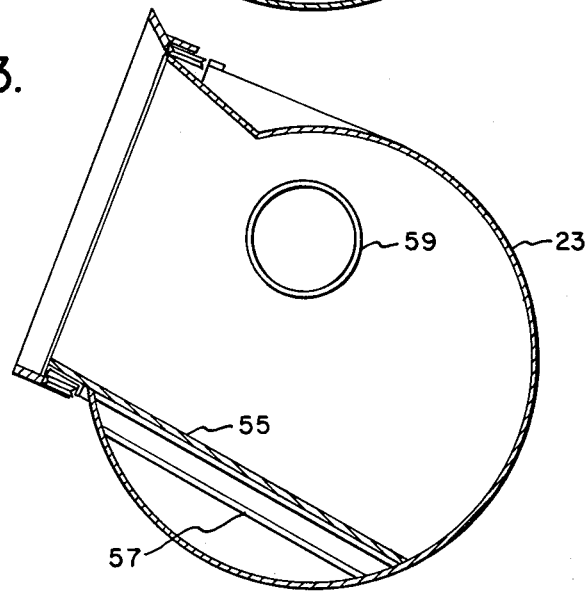
FIG. 3 is a transverse sectional view of the drum hopper of the one-spot quench car positioned to quench the coke within.
Figure 4:
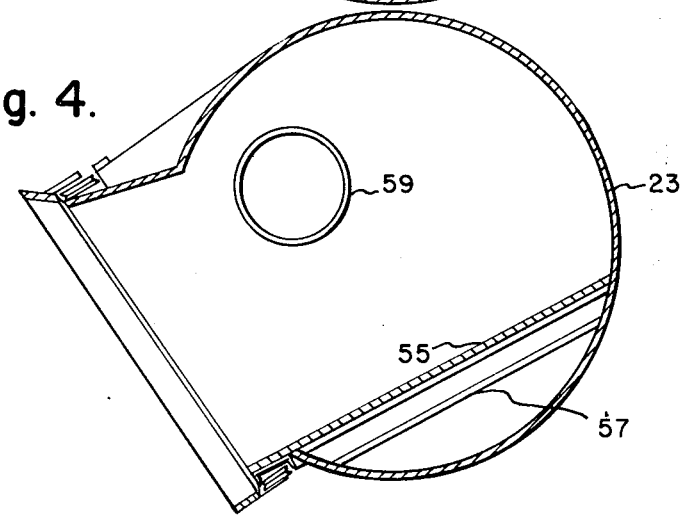
FIG. 4 is a transverse sectional view of the drum hopper of the one-spot quench car positioned to discharge the coke from within onto a coke wharf.
Figure 11:
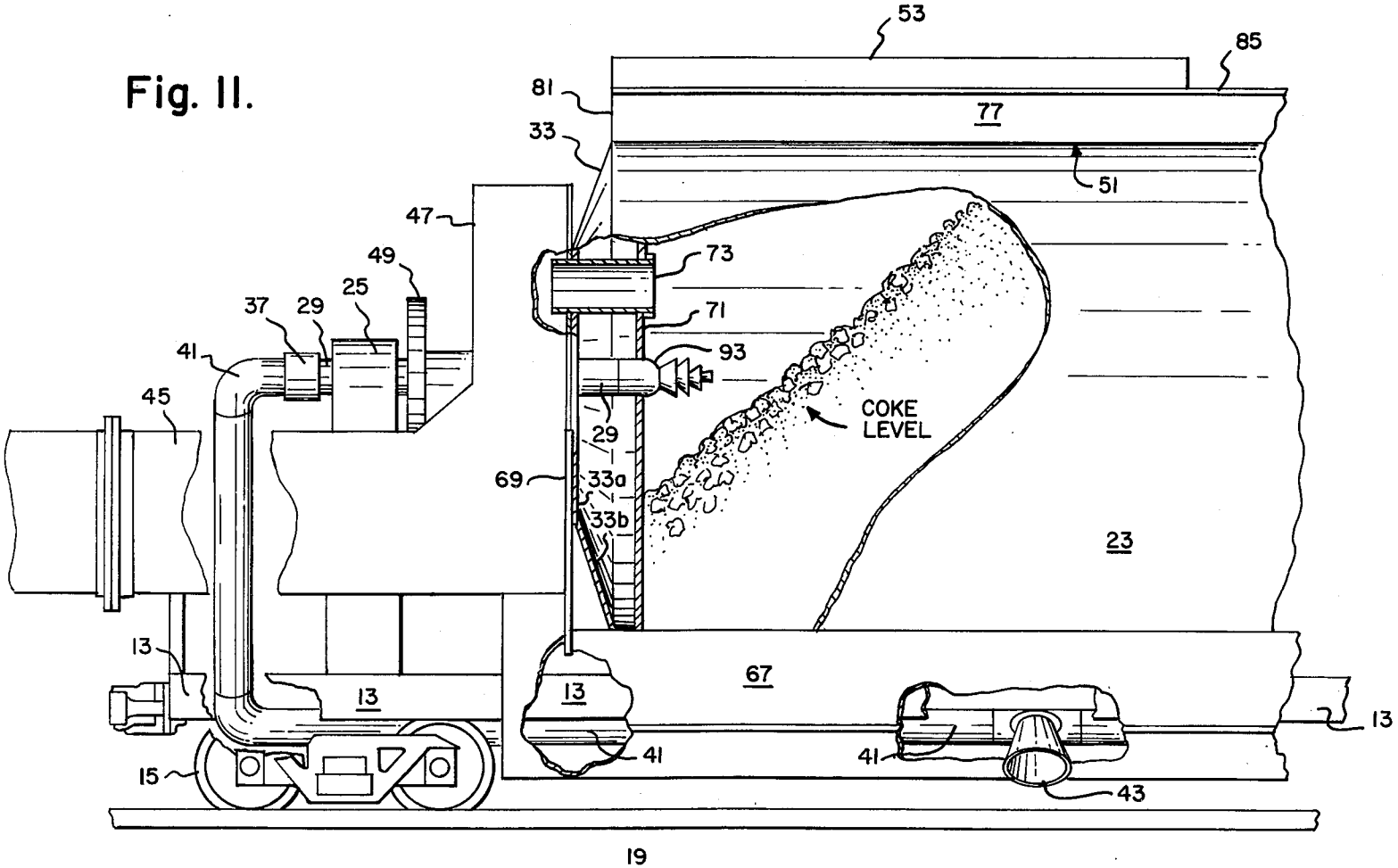
FIG. 11 is an enlarged view of a section of the one-spot quench car, as shown in FIG. 1, with cut-away sections to expose views of the construction thereof.

FIGS. 2, 3 and 4 show transverse sectional views of the drum hopper 23 in various positions of rotation. FIG. 2 shows the drum hopper 23 in the position for loading it with hot coke; FIG. 3 shown the drum hopper 23 rotated to the quench position; and FIG. 4 shows the drum hopper 23 rotated to the discharge position. Positioned within the drum hopper is a secant-like baffle which acts as a slide 55 when the drum hopper 23 is in a position to discharge the coke therein, as illustrated in FIG. 4. The slide 55 also acts as a tumbling means during the rotation of the drum hopper 23. The slide 55 is supported by structural I-beams 57 fixed within the drum hopper 23 about where shown. FIGS. 2, 3 and 4 also depict an aperture 59 in the drum hopper 23. The aperture 59 protrudes through a baffle 71 interposed inside of the drum hopper 23, as illustrated in FIG. 11 and described hereafter. The purpose of this aperture 59 is to provide a means through which pollutants can be extracted into the fume extraction duct 47 and then through the fume duct section 45. The arrangement of the aperture 59 in the baffle 71 in relation to the front end 33 of the drum hopper 23 and in relation to the fume extraction duct 47 and fume duct section 45 is depicted in exploded view in FIG. 9, further described hereafter.

Figure 5:
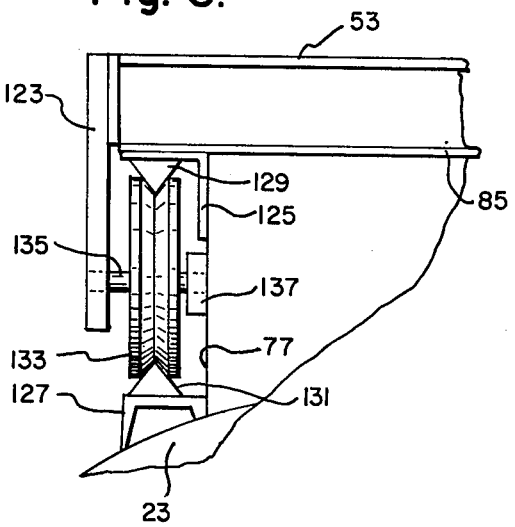
FIG. 5 is an enlarged view of the detail of the means for sliding the cover seal of the drum hopper.

FIG. 5 illustrates the means for slidably moving the cover seal 53 horizontally along the drum hopper 23. A bracket 123 is fixed to the longitudinal edge of the cover seal 53. An angle 125 is fixed to upper edge of the vertical riser wall 77. A channel 127 is mounted adjacent to the line where the vertical riser wall 77 intersects the drum hopper 23 about where shown in FIG. 5. A top triangular track 129 is fixed to the angle 125 about where shown in FIG. 5. A bottom triangular track 131 is fixed to the channel 127 about where shown in FIG. 5. The tracks 129 and 131 are vertically aligned and positioned parallel to each other. A flanged roller 133 is interposed between the tracks 129 and 131 as shown in FIG. 5. The roller 133 has a flange arrangement which is compatible with the angles of the tracks 129 and 131. An axle 135 is rotatably mounted through the roller 133 and fixed, by press fit, through a hole in the bracket 123 and a hole through a boss 137 which is fixed to the exterior surface of the vertical riser wall 77 about where shown in FIG. 5. This arrangement both allows slidable movement of the cover seal 53 across the riser 51 and prevents the cover seal from falling off when the drum hopper 23 is rotated.

Figure 6:
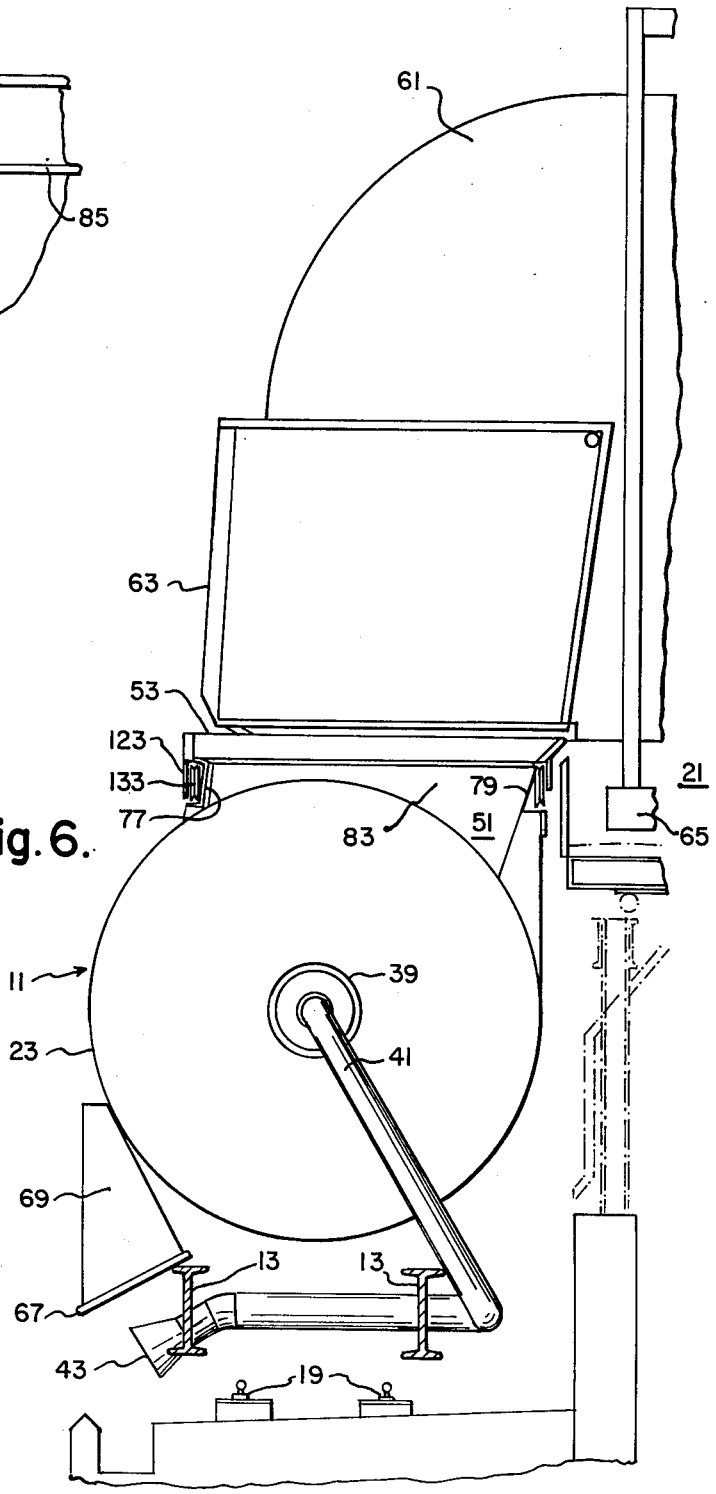
FIG. 6 is a transverse sectional view of the one-spot quench car with the drum hopper positioned to receive coke from a coke oven battery and with the pollution control hoods in position depending from the coke guide.

FIG. 6 illustrates a rear end sectional view of the coke quench car 11 in position adjacent to the coke side 21 of a coke oven battery 115 to receive coke being pushed from that battery. The position of the drum hopper 23 as illustrated in FIG. 6 is identical to the position of the drum hopper 23 illustrated in FIG. 2. Also illustrated in FIG. 6 is a fixed hood 61 and a pivotal hood 63 which is pivotally mounted to the fixed hood 61. The fixed hood 61 is mounted to a coke guide car 65. Also illustrated in FIG. 6 is a slide extension 67 positioned on and mounted to the frame 13. Wing shields 69 are mounted to the slide extension 67.

Figure 8:
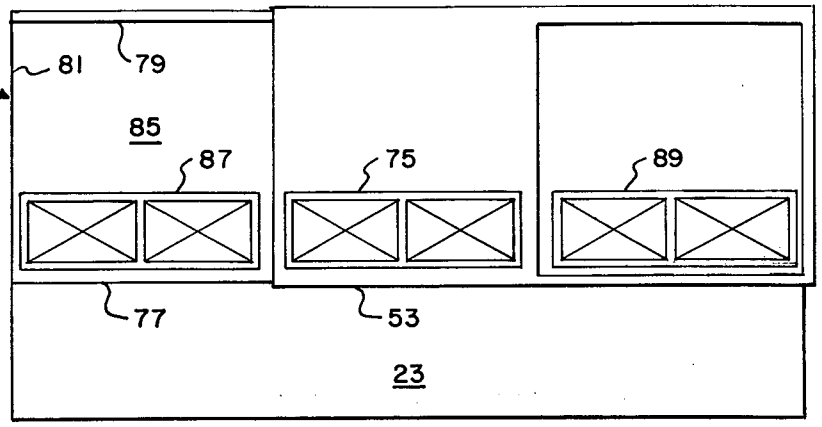
FIG. 8 is a top view of the drum hopper of the one-spot quench car with the cover seal in position to both transport the coke and to discharge the coke.
Figure 7:
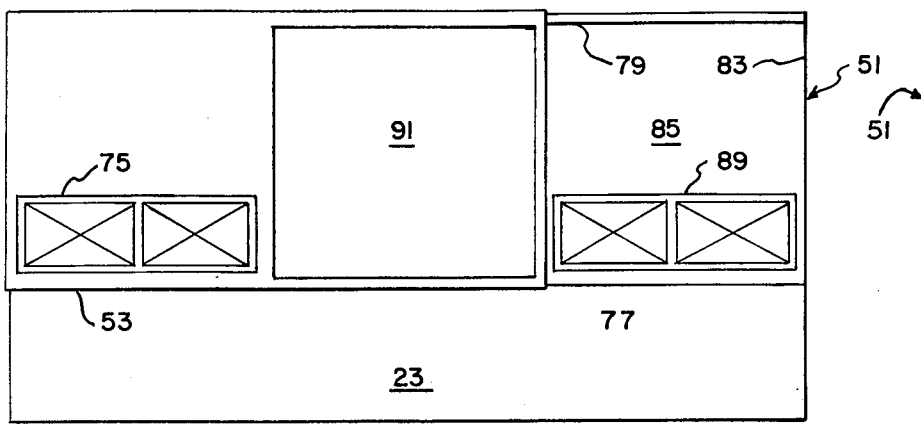
FIG. 7 is a top view of the drum hopper of the one-spot quench car with the cover seal in position to both receive coke from a coke oven battery and to quench that coke.

FIGS. 7 and 8 depict the two positions of the cover seal 53 in relation to the drum hopper 23 and riser 51. FIG. 7 illustrates the cover seal 53 in the position required for the operation of gravitating hot coke into the drum hopper 23 and also for the quenching operation. FIG. 8 illustrates the cover seal 53 in the position required for transporting the coke from the coke oven to the quenching station, as generally depicted by FIG. 12, and also for discharging the coke onto a coke wharf 119, as shown in FIG. 14.

The cover seal 53 has pivotally mounted thereon a discharge door 75. The discharge door 75 serves as a closure for a discharge port located immediately behind the discharge door 75, but not illustrated.

The riser 51 is composed of a vertical riser wall 77, a sloped riser wall 79, a front riser end 81, and a rear riser end 83, all arranged in a rectangle. The riser 51 comprises the parameter of an aperture in the cylinder shape of the drum hopper 23. The riser 51 is covered by a riser top 85. There are two riser discharge doors 87 and 89 pivotally mounted onto the riser top serving as closures for riser discharge ports located immediately behind each of the riser discharge doors 87 and 89, but not shown. Centrally located in the riser top 85 is a main port 91 through which coke enters into the drum hopper 23 and through which steam and particulate matter escape during the quenching operation.

Figure 9:
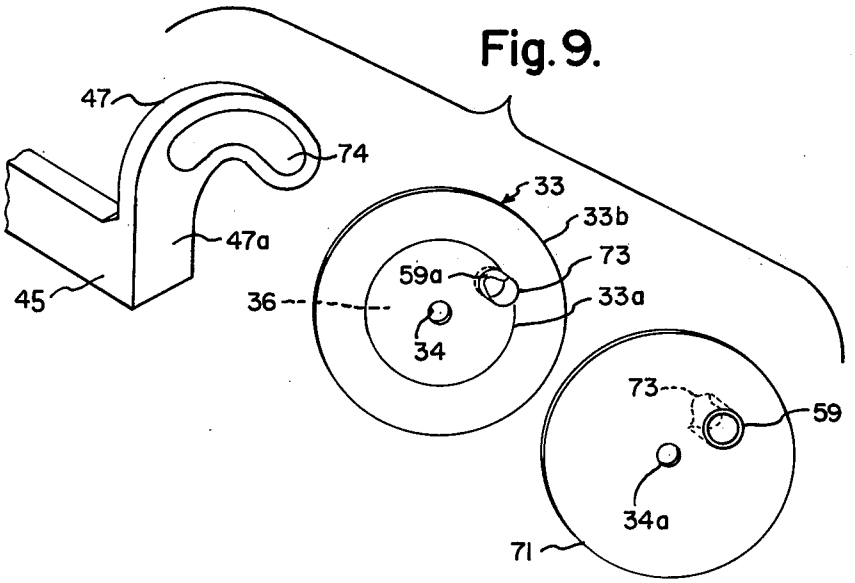
FIG. 9 is an exploded projectional schematic view of the pollution extraction duct work and the end of the drum hopper adjacent thereto.

FIG. 9 shows an exploded projection view of the means through which pollutants are extracted from the drum hopper 23. The front end 33 is composed of a flat circular section 33*a* and a shallow frusto-conical section 33*b* surrounding and continuous with the circular section 33*a*, as shown in FIG. 9. Through the central axis of the circular section 33*a* is pierced a hole 34 through which protrudes the front stub shaft 29. Within the drum hopper 23, positioned generally parallel to the front end 33, is a baffle 71 about where shown in FIG. 11. The baffle 71 is circular in shape and the same diameter of the interior of the drum hopper 23, the baffle 71 being fixed thereto. The baffle also contains a hole 34*a* through its central axis being the same size as the hole 34. Through the hole 34*a* protrudes a water shear nozzle 93, as shown in FIG. 11. There is an aperture 59 through the baffle 71 and a corresponding aperture 59*a* in the circular section 33*a* of the front end 33. Rotation of the drum hopper 23 causes concurrent movement of aperture 59 and corresponding aperture 59*a* as both the baffle 71 and the front end 33 are fixed to the drum hopper 23. Connecting aperture 59 and corresponding aperture 59*a* is an extraction tube 73 through which pollutants flow from the interior of the drum hopper 23 to the fume duct section 47 and then to the fume extraction duct 45 and finally to the conventional gas cleaning car (not shown). The end of the extraction tube 73 on the far side of the circular section 33*a* from the baffle 71 extends into a kidney-shaped slot 74 located in the fume extraction duct 47 about where shown in FIG. 9. The arc of the slot 74 corresponds to the arc of rotation of the drum hopper 23. In operation, the exterior face 36 of the circular section 33*a*, being flat, rotates across the flat face 47*a* of the fume extraction duct 47, thus effecting a moving seal. The baffle 71 is interposed in the drum hopper 23 to prevent the hot coke from contacting the circular section 33*a*, thus minimizing heat warpage of the flat exterior face 36 thereof.

Figure 10:
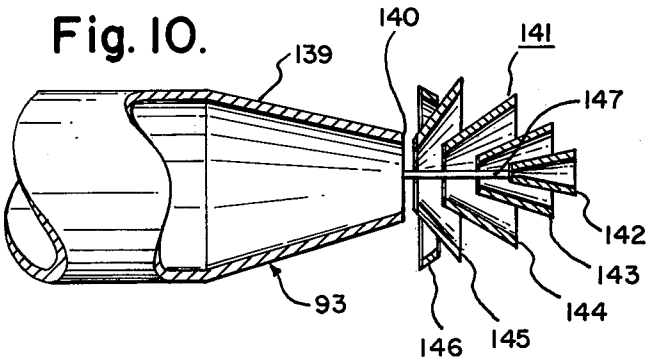
FIG. 10 is a cut-away sectional view of a water shear quench nozzle.

FIG. 10 illustrates a quench water shear nozzle 93, which is mounted to the interior end of the rear stub shaft 31 and also to the interior end of the front stub shaft 29, adjacent the baffle 71 and within the drum hopper 23, about where shown in FIG. 11. The purpose of the shear nozzle 93 is to disperse pressurized quench water within the drum hopper 23 during the quenching operation, in such a manner and with such velocity that the coke within the drum hopper 23 is agitated both from the physical force of the water impinging upon the coke and the explosive flashing of the water into steam. The quench water shear nozzle 93 is comprised of a nozzle body 139 which is in the form of a frusto-conical section and serves to reduce the internal diameter of the stub shafts 29 or 31, to which it is fixed, thus increasing the rate of flow of quench water therefrom. Fixed to the release end 140 of the nozzle body 139 is a water breaker or shear device 141 including a series of frusto-conical section diffusers 142, 143, 144, 145 and 146 interconnected on a spaced-apart relationship by a frame 147 about as shown in FIG. 10. Each of the diffusers is formed in a different inclined angle from each other, with the exception of diffuser 145 and 146 which are formed with identical inclined angles. Diffuser 142 is formed of a lesser inclined angle than diffuser 143, which is formed of a lesser inclined angle than diffuser 144, which is formed of lesser inclined angle than either diffuser 145 or diffuser 146. The series of diffusers is arranged in a common central axis which is also the central axis of the shear nozzle 93. The smaller diameters of diffusers 142, 143, 144 and 145 are arranged facing the release end 140 of the nozzle body 139. Diffuser 146 is reversed in position such that its small diameter faces away from the release end 140 of the nozzle body 139. The pressurized flow of quench water is diverted by the shear device 141 to spread out throughout the interior of the drum hopper 13. However, the shear device 141 is designed specifically to prevent the water flow from becoming a spray or a mist with a higher degree of entrained gas. The purpose of maintaining direct liquid impingement on the hot coke is to enhance a higher degree of explosive displacement of the coke throughout the drum hopper 23 by way of higher volumes of water instantly flashing into steam. The result is a continuous tumbling effect on the coke within the drum hopper 23.

FIG. 11 is an enlarged view of the front portion of the coke quench car depicted in FIG. 1 with certain sections cut away to reveal the details of construction thereof. Sheet metal shielding 95 is provided to prevent the accumulation of debris on the frame 13 and beneath the coke quench car 11. The slope of the coke within the quench car, as illustrated in FIG. 11, is that which would be found after the drum hopper 23 had been fully loaded with coke, but prior to rotation of that drum hopper 23.

FIG. 12 illustrates a transverse sectional view of the coke quench car 11 with the drum hopper 23 in the quench position corresponding to the sectional view of the drum hopper 23 depicted in FIG. 3. The coke quench car 11 is shown adjacent to a steam and particulate matter suppressor generally denominated by the numeral 97. The suppressor 97 is of conventional construction with the exception of a collector hood 99 located about where shown. The purpose of the collector hood 99 is to convey the steam and particulate matter emanating from the quench of the incandescent coke within the drum hopper 23 into the main body of the suppressor 101.

FIG. 13 is an enlarged detailed view of the pressurized quench water input means 103. The input means 103 is comprised of a protector stop 105 mounted to a slide 107 within which is extensibly operable an input nozzle 109 which can be controlled and is movable by extension means 111. Pressurized water is conveyed by pump means (not shown) through an appropriate conduit 113. The conduit must have some degree of flexibility to allow extension of the input nozzle 109. An appropriate conduit 113 is heavy duty dredge hose.

FIG. 14 schematically represents a top lay-out view of the coke oven battery 115, the rails 19 running parallel to the coke side 21 of that battery 115, the quenching station 121, the coke wharf 119, and the coke quench car 11, shown in bold lines at the quenching station as connected to a conventional locomotive gas cleaning car. Shown in phantom outline is the position of the coke quench car 11 at the left end oven of the coke oven battery during the coke pushing operation in which hot coke is gravitated into the drum hopper 23. Also shown in phantom outline is the coke quench car 11 in position for discharging quenched coke at the coke wharf 119. The letter A signifies the initial position of the quench car 11, adjacent a coke oven chamber 117, where the coke is pushed from that chamber 117 into the drum hopper. The quench car 11 is then moved from position A to position B, where the quenching station 121 is located, for the quenching operation. From position B the quench car 11 is moved to position C, where the coke wharf 119 is located, and the quenched coke is discharged. From position C, the coke quench car is returned to another coke oven chamber 117 represented by the letter D, and the cycle is repeated.

In operation the coke quench car 11 is positioned before a coke oven chamber 117 that is ready to be pushed. The means for moving the coke quench car 11 is a conventional self-propelled combination locomotive-gas cleaner car, as shown in FIG. 14. The drum hopper 23 of the coke quench car 11 is positioned in the upright position, as shown in FIG. 2 and FIG. 6. The cover seal 53 is moved to the position shown in FIG. 7. Movement of the cover seal 53 may be effected by any conventional means, for examples, a chain drive or an hydraulic cylinder system, controlled by the operator within the locomotive. The pivoted hood 63 is lowered into place to cover the main port 91 of the drum hopper 23.

A distributor trough (not shown) is located beneath the pivoted hood 63 adjacent the leading edge of the coke guide (not shown) of the coke guide car 65. This distributor trough is next lowered to effect an extension to the coke guide, causing the coke about to be pushed to gravitate at about the transversal mid-point of the drum hopper 23. The operation and function of the distributor trough, as well as the pivotal and fixed hoods 61 and 63, are more fully described and explained in application Ser. No. 785,366 to which this application is a continuation-in-part.

At this point, the gas cleaning equipment on the locomotive commences operation by imposing a suction or negative pressure on the drum hopper 23, by way of the fume duct section 45, fume extraction duct and the extraction tube 73 which are connected to a scrubber (not shown) on the gas cleaning equipment. The cover seal 53 does not provide an absolutely tight seal, as mated to the riser top 85, thus allowing small quantities of surrounding air to be drawn into the drum hopper 23 to create a draft which carries pollutants emanating from the hot incandescent coke through the extraction tube 73, into the fume extraction duct 47, and through the fume duct section 45 into the gas cleaning equipment on the locomotive-gas cleaning car.

Hot incandescent coke is then pushed from the coke oven chamber 117 by conventional pushing means and directed by means of a conventional coke guide car 65 through the fixed hood 61 and the pivotal hood 63 into the drum hopper 23 through the main port 91 to assure a level about as shown in FIG. 11.

When the contents of the coke oven chamber 117 has been gravitated into the drum hopper 23, the distributor trough (not shown) is raised followed by the pivotal hood 63. The cover seal is rapidly moved from the position shown in FIG. 7 to the position shown in FIG. 8. At this time, louvers in the gas cleaning equipment are partially closed to reduce the degree of suction on the drum hopper 23.

The loaded coke quench car 11 is then moved to the quenching station 121. Referring to FIG. 14, this movement is represented by an arrow drawn from point A to point B. Preferably during the course of this movement, the drum hopper 23 is rotated from the position illustrated in FIG. 2 to that illustrated in FIG. 3. The slide 55 within the drum hopper 23 serves as a means for tumbling the hot incandescent coke during this rotation, thus effecting a leveling of the coke within the drum hopper 23. Alternately, the coke quench car 11 may be stationarily positioned at the quenching station 121 before rotating the drum hopper 23.

After the coke quench car 11 has been positioned at the quenching station 121, depicted in FIG. 14 as position B, and the drum hopper 23 has been rotated to the position shown in FIG. 3, commencement of the quenching operation can proceed. The suction on the drum hopper 23 is cut off at this point. Referring to FIG. 12, the riser 51 is shown adjacent to the collector hood 99 of the suppressor 97. The input nozzle 109 is moved into position within the input funnel 43, as also shown in FIG. 13. The cover seal 53 is moved from the position shown in FIG. 8 to the position shown in FIG. 7, exposing the main port 91 within the perimeter of the collector hood 99. Pressurized quench water is forced through the conduit 113, the input nozzle 109, the input funnel 43, up through the pipe manifold 41, then through the stub shafts 29 and 31 and the shear nozzles 93 into the drum hopper 23 where that quench water floods the hot incandescent coke therein. During this period, the gas cleaning apparatus on the locomotive is shut down. The water hits the hot coke at velocity from both ends 33 and 34 of the drum hopper 23, causing agitation and physical displacement of the coke as well as some displacement due to the explosive flashing of the quench water into steam. This displacement serves to further level the coke into a uniform depth within the drum hopper 23. The agitation of the coke enhances the flow of water directly to hot coke beneath the coke surface level within the drum hopper 23, allowing a more even cooling of that coke. Steam and particulate matter emanating from the coke exit the drum hopper 23 through the main port 91 and are conducted by the collector hood 99 into the suppressor 97 where the same are handled in the conventional manner. Residual quench water not converted to steam may be drained off through apertures (not shown) in the side of the drum hopper 23.

After the coke in the drum hopper 23 has been quenched, preferably for a period of from 30 to 90 seconds, the flow of quench water ceases concurrent with the repositioning of the cover seal 53 from the position shown in FIG. 7 to the position shown in FIG. 8.

The coke quench car 11 is moved to the coke wharf 119, as diagramed in FIG. 14, represented by the arrow from point B to point C. At the coke wharf 119, the cover discharge door 75 and the riser discharge doors 89 are released by conventional means rendering them free to pivot. The drum hopper 23 is rotated from the position shown in FIG. 3 to that of FIG. 4. The slide 55 serves as an inclined plane down which the quenched coke can gravitate, through the discharge doors 75, 87 and 89, across the slide extension 67 and onto the coke wharf 119, thus emptying the drum hopper.

The empty drum hopper 23 is then rotated to its original position as shown in FIG. 2 and the quench car 11 is moved to the next coke oven chamber 117 to be pushed, as diagramed in FIG. 14 and indicated by the arrow from position C to position D.

Preferably, the drum hopper 23 is constructed of a heat resistant low alloy steel material or is lined with an appropriate refractory to control the frequency of maintenance cycles and the expense thereof.

According to the provisions of the patent statutes, what is considered to represent the best embodiment of the present invention, its preferred construction and its best mode of operation have been illustrated and described. However, it is to be understood that, within the scope of the appended claims, the invention may be practiced otherwise than as specifically illustrated and described.

What is claimed is:

1. Apparatus for receiving and transporting hot coke from a coking chamber of a coke oven battery to a quenching station where it is cooled and for transporting to and discharging said hot coke, now cooled, onto a coke wharf, comprising:

(a) a vehicle that is movable in a parallel direction along the coke side of a coke oven battery, adjacent to a coke guide of said battery and separated from said battery by the general width of said coke guide;

(b) a rotatable cylindrical drum hopper with closed ends and apertures through each of said ends, said openings aligned to the central linear axis of said drum hopper, said drum hopper having at least one port through which hot coke passes into drum hopper;

(c) trunnion means, interposed through each of said apertures, upon which said drum hopper is rotatable;

(d) conduit means, running through at least one of said trunnion means, through which fluid can be conducted;

(e) bearing means, mounted onto said vehicle, through which said trunnion means are rotatable;

(f) powered rotating means for producing rotation of said drum hopper, operable on at least one trunnion means;

(g) manifold means for conducting fluid to said conduit means;

(h) fluid entry means, located on said vehicle, through which pressurized fluid can be forced into said manifold means and said conduit means into said drum hopper;

(i) slidable cover seal means linearly operable to expose and to cover and seal said at least one port;

(j) a secant plane, disposed peripherally adjacent said at least one port, within said drum hopper, linearly bisecting and fixed to the arc of said drum hopper, removed from the central axis of said drum hopper;

(k) discharge means, adjacent said at least one port, operable to both prevent and permit discharge of coke upon rotation of said drum hopper;

(l) hood means to prevent escape of pollutants to the amosphere during the gravitation of hot coke into said drum hopper through said at least one port;

(m) fume extraction means operable to extract pollutants from said drum hopper during the period when said at least one port is covered and sealed by said cover seal means;

(n) shear means by which fluid passing through said conduit means is increased in velocity and then distributed throughout said drum hopper in a flood, but prevented from becoming a spray, to quench said hot coke within said drum hopper uniformly throughout;

(o) fluid input means to introduce pressurized fluid to said fluid entry means and to pump pressurized fluid introduced to said fluid entry means through said manifold means and said conduit means and said shear means into said drum hopper; and (p) collecting means to collect and convey steam and particulate matter, emanating from the hot coke within said drum hopper during the operation of said fluid input means, expelled from said drum hopper through said at least one port exposed by said slidable cover seal means, to a suppressor.

2. The invention of claim 1 wherein said powered rotating means is adapted to rotate said drum hopper through a limited arc from a loading position, to a quench position and then to a discharge position, and, reversing the direction of rotation, returning to said loading position, the rotation within said limited arc from said loading position to said quenching position serving to level the hot coke with said drum hopper with said secant plane.

3. The invention of claim 1 wherein said trunnion means and said conduit means comprise a pair of hollow stub shafts, one each of which is interposed through and fixed to each of said apertures of said ends, and further comprising a rotatable pressure coupling connecting each of said stub shafts to said manifold means.

4. The invention of claim 3 wherein said manifold means is a pipe joining each of said stub shafts together, externally from said drum hopper, and centrally connected to said fluid entry means.

5. The invention of claim 1 wherein said secant plane is a flat plate fixed to and supported within said drum hopper.

6. The invention of claim 1 wherein said discharge means comprises:

(a) a plurality of discharge doors pivotally mounted onto the surface of said drum hopper linearly adjacent said at least one port; and (b) at least one discharge door pivotally mounted to said cover seal means such that when said cover seal means is in position to cover and seal said at least one port, said at least one discharge door is superimposed over said at least one port.

7. The invention of claim 1 wherein said shear means comprises:

(a) at least one tapered nozzle, mounted to said conduit means, within said drum hopper; and (b) a series of decreasing, included angle tubular frustoconical section fluid deflectors, mounted to the discharge end of each of said nozzle such that the central axis of each deflector is aligned with each other deflector and the central axis of each of said nozzles in a spaced-apart relationship.

* * * * *